US008841245B2

(12) United States Patent
Scialla et al.

(10) Patent No.: US 8,841,245 B2
(45) Date of Patent: Sep. 23, 2014

(54) DETERGENT COMPOSITION

(71) Applicant: The Procter & Gamble Company, Cincinnati, OH (US)

(72) Inventors: Stefano Scialla, Rome (IT); Michael Stanford Showell, Brussels (BE); Frank Hulskotter, Bad Durkheim (DE); Anju Deepali Massey Brooker, Newcastle upon Tyne (GB); Phan Shean Lim, Bukit Batok (SG); Melissa Cuthbertson, Newcastle upon Tyne (GB); Glenn Steven Ward, Newcastle upon Tyne (GB); Rainer Anton Dobrawa, Stuttgart (DE)

(73) Assignee: The Procter & Gamble Company, Cincinnat, OH (US)

( * ) Notice: Subject to any disclaimer, the term of this patent is extended or adjusted under 35 U.S.C. 154(b) by 0 days.

(21) Appl. No.: 13/874,791

(22) Filed: May 1, 2013

(65) Prior Publication Data

US 2013/0303424 A1 Nov. 14, 2013

(30) Foreign Application Priority Data

May 11, 2012 (EP) ..... 12167780

(51) Int. Cl.

| | |
|---|---|
| ***C11D 1/72*** | (2006.01) |
| ***C11D 3/30*** | (2006.01) |
| ***C11D 3/39*** | (2006.01) |
| ***C11D 3/395*** | (2006.01) |
| ***C11D 3/37*** | (2006.01) |
| ***C11D 1/62*** | (2006.01) |

(52) U.S. Cl.

CPC ..... *C11D 1/62* (2013.01); *C11D 3/3951* (2013.01); *C11D 3/3788* (2013.01); *C11D 3/3905* (2013.01); *C11D 3/3723* (2013.01); *C11D 3/378* (2013.01)

USPC ..... 510/220; 510/221; 510/224; 510/372; 510/375; 510/376; 510/439; 510/505; 510/506

(58) Field of Classification Search

USPC ..... 510/220, 221, 224, 372, 375, 376, 439, 510/499, 505, 506; 134/25.2

See application file for complete search history.

(56) References Cited

U.S. PATENT DOCUMENTS

| | | | | |
|---|---|---|---|---|
| 2003/0073596 | A1 | 4/2003 | Chiou et al. | |
| 2006/0234895 | A1 * | 10/2006 | Souter et al. | 510/386 |
| 2006/0234898 | A1 * | 10/2006 | Schneiderman et al. | 510/424 |
| 2007/0275868 | A1 * | 11/2007 | Cooremans et al. | 510/475 |
| 2011/0036374 | A1 * | 2/2011 | Schneiderman et al. | 134/6 |
| 2011/0207646 | A1 * | 8/2011 | Baez Chavez et al. | 510/221 |
| 2011/0262318 | A1 * | 10/2011 | Hofte et al. | 422/272 |
| 2011/0263474 | A1 * | 10/2011 | Somerville Roberts et al. | 510/229 |

FOREIGN PATENT DOCUMENTS

| | | | |
|---|---|---|---|
| EP | 0 998 548 | B1 | 9/2004 |
| WO | WO 95/32272 | A1 | 11/1995 |
| WO | 2006113314 | * | 10/2006 |
| WO | 2006113315 | * | 10/2006 |
| WO | WO 2006/108857 | A1 | 10/2006 |
| WO | WO 2009/060059 | A2 | 5/2009 |
| WO | WO 2010/020765 | A1 | 2/2010 |

OTHER PUBLICATIONS

EP Search Report dtd Nov. 16, 2012; 8 Pages.

* cited by examiner

*Primary Examiner* — Gregory R Delcotto

(74) *Attorney, Agent, or Firm* — Abbey A. Lopez; Amy I. Ahn-Roll

(57) ABSTRACT

An automatic dishwashing detergent composition comprising:

a) an alkoxylated polyalkyleneimine said alkoxylated polyalkyleneimine comprising a polyalkyleneimine backbone, alkoxy chains and quaternization groups wherein the alkoxylated polyalkyleneimine has a degree of quaternization of at least 5% and wherein:

i) the polyalkyleneimine backbone represents from 0.5% to 40% by weight of the alkoxylated polyalkyleneimine;

ii) the alkoxy chains represent from 60% to 99% by weight of the alkoxylated polyalkyleneimine; and b) a bleach system comprising bleach and optionally a bleach enhancer.

13 Claims, No Drawings

DETERGENT COMPOSITION

TECHNICAL FIELD

The present invention is in the field of detergents. In particular, it relates to an automatic dishwashing detergent composition comprising an alkoxylated polyalkyleneimine. The composition provides outstanding removal of bleachable stains.

BACKGROUND OF THE INVENTION

The automatic dishwashing detergent formulator is continuously looking for ways to improve the performance of detergents. Items placed in a dishwasher to be washed are usually stained with different kinds of stains. Tea and coffee stains are particularly difficult to remove. The problem is more acute when the detergent is phosphate free.

The use of polyalkyleneimines in cleaning compositions is known. Traditionally, polyalkyleneimines have been used in laundry detergents to provide soil suspension benefits. Polyethyleneimines have also been used in hard surface cleaning compositions to provide different benefits. For example, WO 2011/051646 discloses a method of treating hard surfaces to improve soil resistance, particularly resistance to oily soils, which comprises applying to the surface a composition comprising a quaternised, polyamine, polypropoxylate, polyethoxylate. WO 2010/020765 discloses the use of a composition comprising a polyalkyleneimine and/or a salt or derivative thereof for the prevention of corrosion of non-metallic inorganic items during a washing or rinsing process.

The objective of the present invention is to provide an automatic dishwashing composition providing improved bleachable stain removal.

SUMMARY OF THE INVENTION

According to a first aspect of the invention, there is provided an automatic dishwashing detergent composition. The composition comprises an alkoxylated polyalkyleneimine and a bleach system. The alkoxylated polyalkyleneimine has a polyalkyleneimine backbone and alkoxy chains. The alkoxylated polyalkyleneimine of the composition of the invention is sometimes herein referred to as "the polyalkyleneimine". The term "alkoxylated polyalkyleneimine" as used herein encompasses any alkoxylated alkyleneimine comprising two or more alkyleneimine repeating units. Preferably the polyalkyleneimine is polyethyleneimine. The alkoxylated polyalkyleneimine has a degree of quaternization of at least 5%, preferably from about 20% to about 100%, more preferably from about 40% to about 98% and especially from about 50% to about 98% by weight of the polyalkyleneimine. In addition to the bleaching performance, the degree of quaternization seems to help with the stability of the polyalkyleneimine in the composition of the invention, in particular it seems to protect the polyalkyleneimine from oxidizing agents such as bleach, contributing to the stability on storage of the composition.

By "degree of quaternization" is herein meant the percentage of amino groups that are permanently quaternized (as opposite to protonated).

In the alkoxylated polyalkyleneimine of the composition of the invention:

i) the polyalkyleneimine backbone represents from 0.5% to 40%, preferably from 1% to 30% and especially from 2% to 20% by weight of the alkoxylated polyalkyleneimine; and ii) the alkoxy chains represent from 60% to 99%, preferably from 50% to about 95%, more preferably from 60% to 90% by weight of the alkoxylated polyalkyleneimine.

The percentages of the polyalkyleneimine backbone and the alkoxy chains are calculated with respect to the quaternized alkoxylated polyalkyleneimine, i.e. including the quaternization groups.

The composition of the invention also comprises a bleach system comprising bleach and optionally a bleach enhancer. The polyalkyleneimine of the invention in combination with bleach or with systems comprising bleach and bleach enhancer provides outstanding bleaching benefits. Without being bound by theory, it is believed that the polyalkyleneimine can form complexes with bleach species generated from the bleach system, the complexes have such a charge and steric configuration that are driven to the stained surfaces, thus the bleach species can work on removing the stains in situ instead of in the bulk of the cleaning solution, that is where usually takes place. This mechanism seems to be extremely efficient for stain removal, especially for the removal of tea and coffee stains. The relationship between the weight of the polyalkyleneimine backbone and the weight of the alkoxy chains of the alkoxylated polyalkyleneimine and the degree of quaternization of the polyalkyleneimine seem to be critical for the formation of bleach species/polyalkyleneimine complexes that would selectively go to bleachable stains improving the efficacy of the bleach system.

In preferred embodiments the alkoxy chains have an average of from about 1 to about 50, more preferably from about 2 to about 40, more preferably from about 3 to about 30 and especially from about 3 to about 20 and even more especially from about 4 to about 15 alkoxy units preferably ethoxy units. Preferably the polyalkyleneimine is polyethyleneimine. Compositions comprising polyethyleneimines having an average of from about 1 to about 50, preferably from about 2 to about 40, more preferably from about 3 to about 30 and especially from about 3 to about 20 and even more especially from about 4 to about 15 ethoxy units have been found to provide outstanding bleaching benefits.

In other embodiments, the alkoxy chains have an average of from about 0 to 30, more preferably from about 1 to about 12, especially from about 1 to about 10 and even more especially from about 1 to about 8 propoxy units. Especially preferred are alkoxylated polyethyleneimines wherein the alkoxy chains comprise a combination of ethoxy and propoxy chains, in particular polyethyleneimines comprising chains of from 4 to 20 ethoxy units and from 0 to 6 propoxy units.

In preferred embodiments the alkoxylated polyalkyleneimine is obtained from alkoxylation followed by quaternization of a polyalkyleneimine, wherein the starting polyalkyleneimine has a weight-average molecular weight of from about 100 to about 60,000, preferably from about 200 to about 40,000, more preferably from about 300 to about 10,000 g/mol.

In preferred embodiments the bleach is selected from the group consisting of inorganic bleach, organic bleach and mixtures thereof. Compositions comprising inorganic bleach, in particular sodium percarbonate have been found to provide good bleaching performance.

By "bleach enhancer" is herein meant any ingredient that helps the bleach with the bleaching process, i.e. that improves the performance of the bleach, by either providing the same bleaching with lower level of bleach or providing better bleaching with the same level of bleach. The bleach enhancer is preferably selected from a bleach catalyst, a bleach activator and mixtures thereof.

In preferred embodiments the bleach enhancer is a bleach catalyst, preferably a metal bleach catalyst wherein the metal is selected from the group consisting of cobalt, manganese, iron, copper and mixtures thereof. Outstanding performance has been found when the metal is manganese.

In other preferred embodiments the bleach enhancer is a bleach activator, preferably the bleach activator is selected from the group consisting of TAED, NOBS, DOBA and mixtures thereof. The most preferred bleach activator for use herein is TAED.

Compositions comprising bleach systems comprising percarbonate and bleach catalyst, in particular a manganese bleach catalyst and systems comprising percarbonate and a bleach activator, in particular TAED have been found to provide really good bleaching. Systems comprising percarbonate, bleach catalyst, in particular manganese bleach catalyst, and bleach activator, in particular TAED, have also been found to provide improved bleaching.

The composition of the invention gives rise to outstanding bleachable stain removal benefits even when it is phosphate free. Especially good performance is obtained when the composition comprises a sulfonated polymer.

The compositions of the invention could be in any form, powder, liquid, etc. It has been found here that unit dose form provides a very convenient form for the composition of the invention, it prevents segregation that could occur if the composition is in powder or possibly liquid form. Segregation issues are especially problematic in compositions comprising ingredients in catalytic amounts such as the bleach enhancer.

According to another aspect of the invention, there is provided a method of cleaning cookware/tableware in an automatic dishwashing machine comprising the step of subjecting stained, preferably with tea and coffee stains, cookware/tableware to a washing liquor comprising the composition of the invention.

According to the last aspect of the invention, there is provided the use of the composition of the invention for the removal of bleachable stains, preferably tea and coffee stains, from cookware/tableware in automatic dishwashing.

DETAILED DESCRIPTION OF THE INVENTION

The present invention envisages an automatic dishwashing detergent composition. The composition comprises an alkoxylated polyalkyleneimine and a bleach system and provides improved removal of bleachable stains, in particular tea and coffee stains. There is also provided a method of automatic dishwashing using the composition of the invention and the use of the composition for the removal of bleachable stains, especially tea and coffee stains from cookware and tableware.

Alkoxylated polyalkyleneimine

The alkoxylated polyalkyleneimine preferably comprises polyethyleneimine and more preferably it is a polyethyleneimine. Preferably the composition of the invention comprises from 0.1% to about 5%, preferably from about 0.2% to about 3% by weight of the composition of the polyalkyleneimine. Preferably the method of the invention delivers from about 20 to about 100 ppm of the polyalkyleneimine.

The alkoxylation of the polyalkyleneimine backbone comprises one or two alkoxylation modifications in a nitrogen atom, depending on whether the modification occurs at an internal nitrogen atom or at a terminal nitrogen atom in the polyalkyleneimine backbone, the alkoxylation modification involves the replacement of a hydrogen atom in a polyalkyleneimine by a monoalkoxylene or a polyalkoxylene chain preferably having an average of from about 1 to about 50 alkoxy units, wherein the terminal alkoxy unit of the polyalkoxylene chain is capped with hydrogen, C1-C4 alkyl or mixtures thereof. In addition, each nitrogen atom in the alkoxylated polyalkyleneimine may carry saturated or unsaturated, linear or branched alkyl, alkylaryl or aryl substituents, or combinations thereof, preferably benzyl substituents and/or C1-C12, preferably C1-C4 alkyl, aryl or alkylaryl substituents, resulting in neutral or cationic charge on each nitrogen atom depending on its total number of substituents. These modifications may result in permanent quaternization of polyalkyleneimine backbone nitrogen atoms. The degree of permanent quaternization is at least 5%, preferably at least 20%, more preferably from at least from 40% to 100% of the polyalkyleneimine backbone nitrogen atoms.

Preferably, all the nitrogen atoms would comprise alkoxylation modification(s) although it might be possible to have polyalkyleneimines wherein only part of the nitrogen atoms have been alkoxylated.

Examples of possible modifications are herein shown, the modifications correspond to terminal nitrogen atoms in the polyethyleneimine backbone where R represents an ethylene spacer and E represents a $C_1$-$C_{12}$ alkyl unit and $X^-$ represents a suitable water soluble counterion, such as chlorine, bromine or iodine, sulphate (i.e. —O—SO3H or —O—SO3-), alkylsulfonate such as methylsulfonate, arylsulfonate such as tolylsulfonate, and alkyl sulphate, such as methosulphate (i.e. —O—SO2-OMe)).

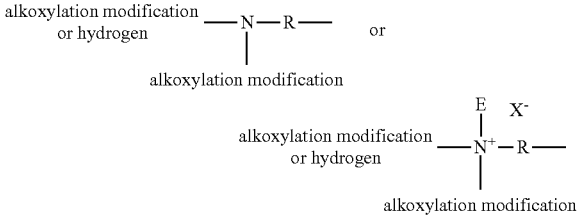

Examples of possible modifications are shown, the modifications correspond to internal nitrogen atoms in the polyethyleneimine backbone where R represents an ethylene spacer and E represents a $C_1$-$C_{12}$ alkyl unit and X— represents a suitable water soluble counterion.

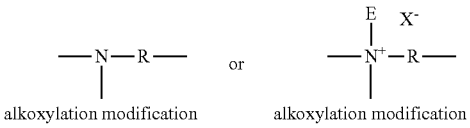

Also, for example, but not limited to, below is shown possible modifications to internal nitrogen atoms in the polyethyleneimine backbone where R represents an ethylene spacer and E represents a $C_1$-$C_{12}$ alkyl unit and X— represents a suitable water soluble counterion.

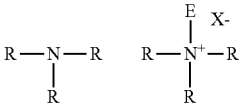

The alkoxylation modification of the polyalkyleneimine backbone may comprise the replacement of a hydrogen atom by a polyalkoxylene chain having an average of about 1 to about 50 alkoxy units, preferably from about 2 to about 40 alkoxy units, more preferably from about 3 to about 30 units and especially from about 3 to about 20 alkoxy units. The alkoxy units are preferably selected from ethoxy (EO), 1,2-propoxy (1,2-PO), butoxy (BO), and combinations thereof. Preferably, the polyalkoxylene chain is selected from ethoxy units and a combination of ethoxy and propoxy units. More preferably, the polyalkoxylene chain comprises ethoxy units in an average degree of from about 1 to about 50, more preferably from about 2 to about 40 and especially from about 3 to 20. Polyalkyleneimines comprising this degree of ethoxy units have been found to provide best performance in terms of removal of bleachable stains, in particular tea and coffee stains. Also preferred in terms of bleachable stain removal are polyalkoxylene chains comprising a mixture of ethoxy and propoxy chains, preferably the polyalkoxylene chain comprises ethoxy units in an average of from about 1 to about 30 and more preferably propoxy units in an average degree of from about 0 to about 10, more preferably from about 2 to about 20 ethoxy units and from about 1 to about 10 propoxy units.

An example of a preferred alkoxylated polyethyleneimine has the general structure of formula (I) or a quaternized version (II):

Formula (1)

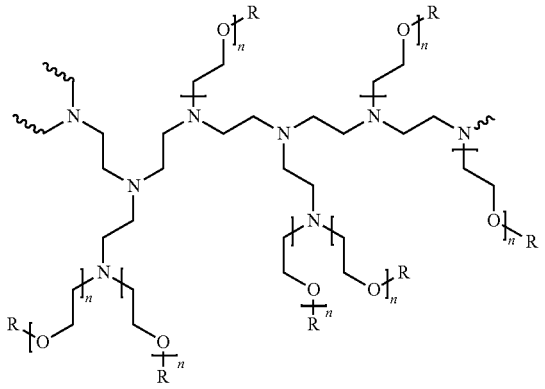

non-quaternized

-continued formula (II)

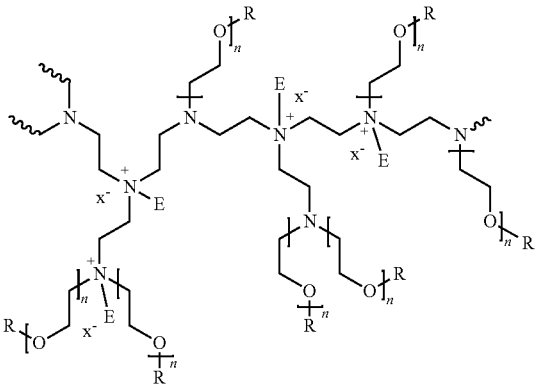

quaternized wherein the polyethyleneimine backbone has a weight average molecular weight of from about 600 to about 5000 g/mole, n of formula (I) or (II) has an average of 3 to 20 and R of formula (I) is selected from hydrogen, a $C_1$-$C_4$ alkyl or benzyl, and mixtures thereof. The degree of quaternization of the polyalkyleneimine backbone of formula (II) may be at least 5%, more preferably at least 20% and especially 70% or higher of the polyalkyleneimine backbone nitrogen atoms.

Another preferred polyethyleneimine has the general structure of formula (III), with the quaternized version shown as formula (IV):

formula (III)

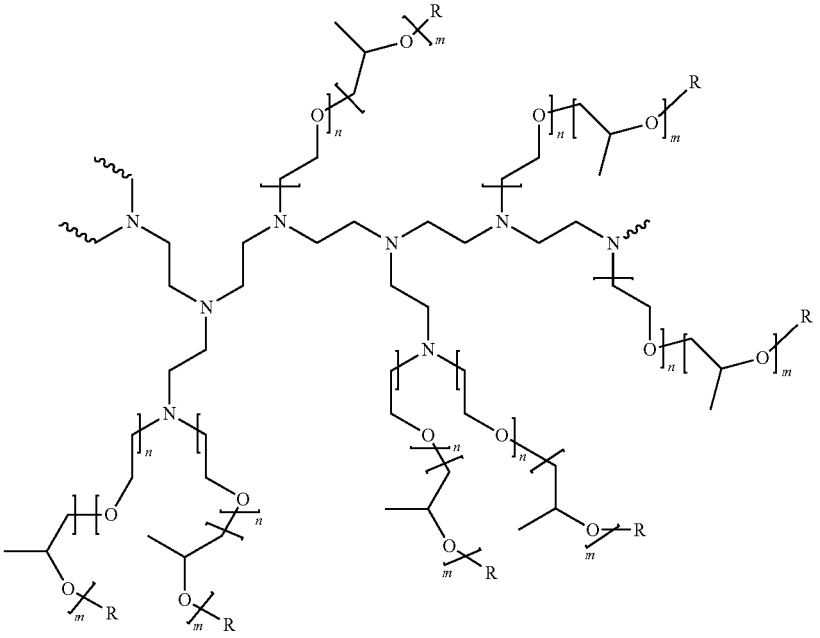

-continued formula (IV)-quaternized

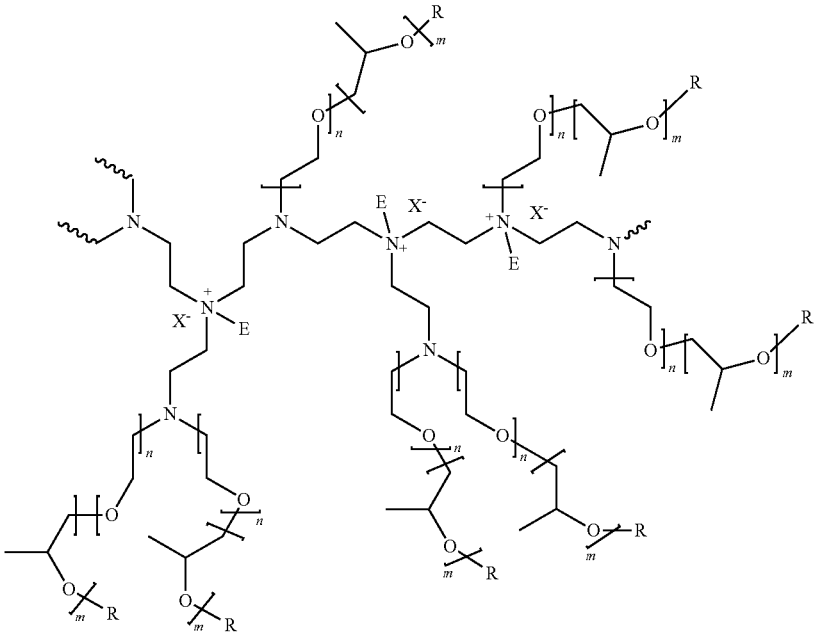

wherein the polyethyleneimine backbone has a weight average molecular weight of from about 600 to about 5000 g/mole, n of formulas (III) and (IV) has an average of 7, m of formulas (III) and (IV) have an average of 1 and R of formula (III) and (IV) is selected from hydrogen, a $C_1$-$C_4$ alkyl and mixtures thereof. The degree of permanent quaternization of formula (IV)) may be from 5% to 100%, preferably at least 10%, more preferably at least 20% of the polyethyleneimine backbone nitrogen atoms.

Polyalkyleneimines suitable for the composition of the invention can be prepared, for example, by polymerizing ethyleneimine in the presence of a catalyst such as carbon dioxide, sodium bisulfite, sulfuric acid, hydrogen peroxide, hydrochloric acid, acetic acid, and the like.

The alkoxylated polyalkyleneimines may be prepared in a known manner by reaction of polyalkylene imines with alkoxy units, the process would herein be described for the ethoxylation of polyoxyethyleneimine.

One preferred procedure consists in initially undertaking only an incipient ethoxylation of the polyalkylene imine in a first step. In this step, the polyalkylene imine is reacted only with a portion of the total amount of ethylene oxide used, which corresponds to about 1 mol of ethylene oxide per mole of NH unit. This reaction is undertaken generally in the absence of a catalyst in an aqueous solution at a reaction temperature from about 70 to about 200° C. and preferably from about 80 to about 160° C. This reaction may be affected at a pressure of up to about 10 bar, and in particular up to about 8 bar.

In a second step, the further ethoxylation is then undertaken by subsequent reaction with the remaining amount of ethylene oxide. The further ethoxylation is undertaken typically in the presence of a basic catalyst. Examples of suitable catalysts are alkali metal and alkaline earth metal hydroxides such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides such as sodium hydride and calcium hydride, and alkali metal carbonates such as sodium carbonate and potassium carbonate. Preference is given to the alkali metal hydroxides and the alkali metal alkoxides, particular preference being given to potassium hydroxide and sodium hydroxide. Typical use amounts for the base are from 0.05 to 10% by weight, in particular from 0.5 to 2% by weight, based on the total amount of polyalkyleneimine and alkylene oxide.

The further ethoxylation may be undertaken in substance (variant a)) or in an organic solvent (variant b)). In variant a), the aqueous solution of the incipiently ethoxylated polyalkyleneimine obtained in the first step, after addition of the catalyst, is initially dewatered. This can be done in a simple manner by heating to from about 80 to about 150° C. and distilling off the water under a reduced pressure of from about 0.01 to about 0.5 bar. The subsequent reaction with the ethylene oxide is effected typically at a reaction temperature from about 70 to about 200° C. and preferably from about 100 to about 180° C. The subsequent reaction with the alkylene oxide is effected typically at a pressure of up to about 10 bar and in particular up to 8 bar. The reaction time of the subsequent reaction with the ethylene oxide is generally about 0.5 to about 4 hours.

Suitable organic solvents for variant b) are in particular nonpolar and polar aprotic organic solvents. Examples of particularly suitable nonpolar aprotic solvents include aliphatic and aromatic hydrocarbons such as hexane, cyclohexane, toluene and xylene. Examples of particularly suitable polar aprotic solvents are ethers, in particular cyclic ethers such as tetrahydrofuran and dioxane, N,N-dialkylamides such as dimethylformamide and dimethylacetamide, and N-alkyllactams such as N-methylpyrrolidone. It is of course also possible to use mixtures of these organic solvents. Preferred organic solvents are xylene and toluene.

In variant b), the solution obtained in the first step, after addition of catalyst and solvent, is initially dewatered, which is advantageously done by separating out the water at a temperature of from about 120 to about 180° C., preferably supported by a gentle nitrogen stream. The subsequent reaction with the alkylene oxide may be effected as in variant a). In variant a), the alkoxylated polyalkyleneimine is obtained directly in substance and may be converted if desired to an aqueous solution. In variant b), the organic solvent is typically removed and replaced by water. The products may, of course, also be isolated in substance.

The quaternization of alkoxylated polyethyleneimines is achieved preferably by introducing $C_1$-$C_{12}$ alkyl, aryl or alkylaryl groups and may be undertaken in a customary manner by reaction with corresponding alkyl-, alkylaryl-halides and dialkylsulfates, as described for example in WO2009060059.

The quaternization of ethoxylated polyethyleneimines is achieved preferably by reacting the amines with at least one alkylating compound, which is selected from the compounds of the formula EX, wherein E is C1-C12 alkyl, aryl or alkyl and X is a leaving group, which is capable of being replaced by nitrogen (and C2-C6 alkylene oxide, especially ethylene oxide or propylene oxide).

Suitable leaving groups X are halogen, especially chlorine, bromine or iodine, sulphate (i.e. —O SO3H or —O SO3-), alkylsulfonate such as methylsulfonate, arylsulfonate such as tolylsulfonate, and alkyl sulphate, such as methosulphate (i.e. —O SO2 OMe). Preferred alkylating agents EX are C1-C12 alkyl halides, bis(C1-C12-alkyl)sulfates, and benzyl halides. Examples of such alkylating agents are ethyl chloride, ethyl bromide, methyl chloride, methyl bromide, benzyl chloride, dimethyl sulphate, diethyl sulphate.

The amount of alkylating agent determines the amount of quaternization of the amino groups in the polymer. The amount of the quaternization can be calculated from the difference of the amine number in the non-quaternized amine and the quaternized amine.

The amine number can be determined according to the method described in DIN 16945.

The reaction can be carried out without any solvent, however, a solvent or diluent like water, acetonitrile, dimethylsulfoxide, N-Methylpyrrolidone, etc. may be used. The reaction temperature is usually in the range from 10° C. to 150° C. and is preferably from 50° C. to 110° C. All molecular weights related to the alkoxylated polyalkyleneimine of the composition of the invention are weight-average molecular weights expressed as grams/mole, unless otherwise specified. The molecular weight can be measured using gel permeation chromatography.

Molecular Weight Determination:

Molecular weight is determined as weight-average molecular weight ($M_w$) by gel permeation chromatography (GPC) using a serial configuration of the GPC columns HEMA Bio linear, 40·8 mm 10 μm, HEMA Bio 100, 300·8 mm, 10 μm, HEMA Bio 1000, 300·8 mm, 10 μm and HEMA Bio 10000, 300·8 mm, 10 μm, (obtained from PSS Polymer Standards Service GmbH, Mainz, Germany). The eluent is 1.5% aqueous formic acid, flow is 1 ml/min, injected volume is 20 μl, sample concentration is 1%. The method is calibrated with a Pullulan standard (MW 342-1660000 g/mol, obtained from PSS Polymer Standards Service GmbH, Mainz, Germany). Preferably the polyalkyleneimine is preferably free of other alkyleneoxide units other than ethoxy and propoxy.

SYNTHESIS EXAMPLES

Example 1

Synthesis of PEI5000+7EO/NH, 50% quaternized with dimethyl sulfate a) PEI5000+1EO/NH In a 3.5 l autoclave 2568.0 g of a polyethyleneimine 5000 (average molecular weight $M_w$ of 5000, 50% solution in water) were heated to 80° C. and purged three times with nitrogen up to a pressure of 5 bar. After the temperature had been increased to 110° C., 1314.2 g ethylene oxide were added in portions up to 7 bar. To complete the reaction, the mixture was allowed to post-react for 2 h at 110° C. The reaction mixture was stripped with nitrogen and volatile compounds were removed in vacuum at 70° C. The temperature was increased to 90-110° C. and the mixture was dewatered for 2 hours in vacuum.

2580.0 g of polyethyleneimine 5000 with 1 mole of ethylene oxide per mole NH were obtained as a dark brown viscous oil (Amine value: 512 mg KOH/g).

b) PEI5000+7EO/NH

In a 5 l autoclave 997.6 g of the product obtained in Example 1a) and 29.9 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 140° C. and 3027.2 g ethylene oxide were added in portions up to 7 bar. To complete the reaction, the mixture was allowed to post-react for 2 h at 120° C. The reaction mixture was stripped with nitrogen and volatile compounds were removed in vacuum at 70° C.

4040.0 g of a polyethyleneimine 5000 with 7 mole of ethylene oxide per mole NH bond were obtained as a brown viscous liquid (Amine value: 137.4 mg KOH/g; pH of a 10% by weight aqueous solution: 11.7; viscosity (70° C.): 325 mPas).

c) PEI5000+7EO/NH, 50% quaternized with dimethyl sulfate

In a 2 l reaction vessel 1500.0 g of the product from example 1b) was heated to 70-75° C. under a constant stream of nitrogen. 232.0 g dimethyl sulfate was added within 2 h. The reaction mixture was stirred for additional 2 h at 75° C.

1720.0 g of light brown solid were obtained (Amine value: 63.3 mg KOH/g; pH of a 10% by weight aqueous solution: 7.8; Viscosity (70° C.): 838 mPas).

Example 2

Synthesis of PEI600+10EO/NH, 75% quaternized with dimethyl sulfate a) PEI600+1EO/NH In a 3.5 l autoclave 1328.5 g of a polyethyleneimine 600 (average molecular weight $M_w$ of 600) and 66.4 g water were heated to 80° C. and purged three times with nitrogen up to a pressure of 5 bar. After the temperature had been increased to 120° C., 1359.4 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C. The temperature was increased to 90-110° C. and the mixture was dewatered for 2 hours in vacuo.

2688.0 g of polyethyleneimine 600 with 1 mole of ethylene oxide per mole NH were obtained as a yellow viscous oil (Amine value: 549 mg KOH/g; pH of a 1% by weight aqueous solution: 11.06).

b) PEI600+10 EO/NH

In a 5 l autoclave 704.5 g of the product obtained in Example 1a) and 21.1 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 3206.7 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

3968.0 g of a polyethyleneimine 600 with 10 mole of ethylene oxide per mole NH bond were obtained as a yellow-brown viscous liquid (Amine value: 101.5 mg KOH/g; pH of a 10% by weight aqueous solution: 11.6).

c) PEI600+10 EO/NH, 75% quaternized with dimethyl sulfate

In a 0.5 l reaction vessel 120.0 g of the product from example 1b) was heated to 70-75° C. under a constant stream of nitrogen. 20.5 g dimethyl sulfate was added within 15 min. The reaction mixture was stirred for additional 2 h at 75° C. For adjusting pH, 1.0 g NaOH (50% in water) was added.

110.0 g of light brown solid were obtained (Amine value: 23.5 mg KOH/g; pH of a 10% by weight aqueous solution: 9.3).

Example 3

Synthesis of PEI600+7EO/NH, 75% quaternized with dimethyl sulfate a) PEI600+7 EO/NH In a 2 l autoclave 261.0 g of the product obtained in Example 1a) and 7.8 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 792.0 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

1056.0 g of a polyethyleneimine 600 with 7 mole of ethylene oxide per mole NH bond were obtained as a yellow-brown viscous liquid (Amine value: 147.8 mg KOH/g; pH of a 10% by weight aqueous solution: 11.6).

b) PEI600+7 EO/NH, 75% quaternized with dimethyl sulfate

In a 0.5 l reaction vessel 250.0 g of the product from example 2a) was heated to 70-75° C. under a constant stream of nitrogen. 58.4 g dimethyl sulfate was added within 15 min. The reaction mixture was stirred for additional 2 h at 75° C.

299.0 g of light brown solid were obtained (Amine value: 35.84 mg KOH/g; pH of a 10% by weight aqueous solution: 6.0; Iodine color number (10% in water): 4.0).

Bleach System

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Preferably, the level of bleach in the composition of the invention is from about 1 to about 20%, more preferably from about 2 to about 15%, even more preferably from about 3 to about 12% and especially from about 4 to about 10% by weight of the composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.01 to about 10%, preferably from about 0.1 to about 5% and more preferably from about 1 to about 4% by weight of the total composition.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16.

Suitable catalysts for use herein include cobalt (III) catalysts having the formula:

$$Co[(NH3)_nM_mB_bT_tQ_qP_p]Y_y$$

wherein cobalt is in the +3 oxidation state; n is an integer from 0 to 5 (preferably 4 or 5; most preferably 5); M represents a monodentate ligand; m is an integer from 0 to 5 (preferably 1 or 2; most preferably 1); B represents a bidentate ligand; b is an integer from 0 to 2; T represents a tridentate ligand; t is 0 or 1; Q is a tetradentae ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts have the formula:

$$[Co(NH3)n(M)m]Yy$$

wherein n is an integer from 3 to 5 (preferably 4 or 5; most preferably 5); M is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The most preferred cobalt catalyst useful herein has the formula [Co(NH3)5Cl]Yy., and especially [Co(NH3)5Cl]Cl2.

Suitable M, B, T, Q and P ligands for use herein are known, such as those ligands described in U.S. Pat. No. 4,810,410, to Diakun et al, issued Mar. 7, 1989. In addition, examples of M include pyridine and SCN; examples of B include ethylenediamine, bipyridine, acetate, phenthroline, biimidazole, and tropolone; examples of T include terpyridine, acylhydrazones of salicylaldehyde, and diethylenetriamine; examples of Q include triethylenetetramine, N(CH2CH2NH2)3, Schiff bases (for example HOCH2CH2C═NCH2CH2N═CCH2CH20H); and examples of P include polyimidazoles and HOCH2CH2C═NCH2CH2NH—CH2CH2N═CCH2CH2OH.

These cobalt catalysts are readily prepared by known procedures, such as taught for example in U.S. Pat. No. 4,810,410, to Diakun et al, issued Mar. 7, 1989, and J. Chem. Ed. (1989), 66 (12), 1043-45; The Synthesis and Characterization of Inorganic Compounds, W. L. Jolly (Prentice-Hall; 1970), pp. 461-3.

Manganese bleach catalysts are preferred for use in the composition of the invention. These catalysts in combination with the polyalkyleneimine provide the best results in terms of removal of bleachable stains. Especially preferred catalyst for use here is a dinuclear manganese-complex having the general formula:

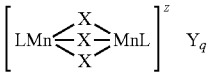

wherein Mn is manganese which can individually be in the III or IV oxidation state; each x represents a coordinating or bridging species selected from the group consisting of H2O, O22-, O2-, OH—, HO2-, SH—, S2-, >SO, Cl—, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y].

Preferred manganese-complexes are those wherein x is either $CH_3COO^-$ or $O^2$ or mixtures thereof, most preferably wherein the manganese is in the IV oxidation state and x is $O^{2-}$. Preferred ligands are those which coordinate via three nitrogen atoms to one of the manganese centres, preferably being of a macrocyclic nature. Particularly preferred ligands are:

1,4,7-trimethyl-1,4,7-triazacyclononane,(Me-TACN); and (1)

1,2,4,7-tetramethyl-1,4,7-triazacyclononane,(Me-Me TACN). (2)

The type of counter-ion Y for charge neutrality is not critical for the activity of the complex and can be selected from, for example, any of the following counter-ions: chloride; sulphate; nitrate; methylsulphate; surfanctant anions, such as the long-chain alkylsulphates, alkylsulphonates, alkylbenzenesulphonates, tosylate, trifluoromethylsulphonate, perchlorate ($ClO_4^-$), $BPh_4^-$, and $PF_6^-$' though some counter-ions are more preferred than others for reasons of product property and safety.

Consequently, the preferred manganese complexes useable in the present invention are:

$$[(Me\text{-}TACN)Mn^{IV}(\hat{A}\mu\text{–}0)_3Mn^{IV}(Me\text{-}TACN)]^{2+}(PF_6^-)_2 \quad (I)$$

$$[(Me\text{-}MeTACN)Mn^{IV}(\hat{A}\text{–}0)_3Mn^{IV}(Me\text{-}MeTACN)]^{2+}(PF_6^-)_2 \quad (II)$$

$$[(Me\text{-}TACN)Mn^{III}(\hat{A}\mu\text{–}0)(\hat{A}\mu\text{–}OAc)_2Mn^{III}(Me\text{-}TACN)]^{2+}(PF_6^-)_2 \quad (III)$$

$$[(Me\text{-}MeTACN)Mn^{III}(\hat{A}\mu\text{–}0)(\hat{A}\mu\text{–}OAc)_2Mn^{III}(Me\text{-}MeTACN)]^{2+}(PF_6^-)_2 \quad (IV)$$

which hereinafter may also be abbreviated as:

$$[Mn^{IV}{}_2(\hat{A}\mu\text{–}0)_3(Me\text{-}TAcN)_2](PF_6)_2 \quad (I)$$

$$[Mn^{IV}{}_2(\hat{A}\mu\text{–}0)_3(Me\text{-}MeTACN)_2](PF_6)_2 \quad (II)$$

$$[Mn^{III}{}_2(\hat{A}\mu\text{–}0)(\hat{A}\mu\text{–}OAc)_2(Me\text{-}TACN)_2](PF_6)_2 \quad (III)$$

$$[Mn^{III}{}_2(\hat{A}\mu\text{–}0)(\hat{A}\mu\text{–}OAc)_2(Me\text{-}TACN)_2](PF_6)_2 \quad (IV)$$

The structure of I is given below:

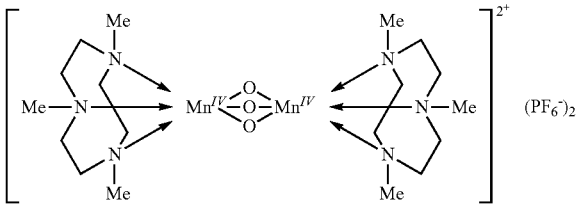

abbreviated as $[Mn^{IV}{}_2(\hat{A}\mu\text{–}0)_3(Me\text{-}TACN)_2](PF_6)_2$.

The structure of II is given below:

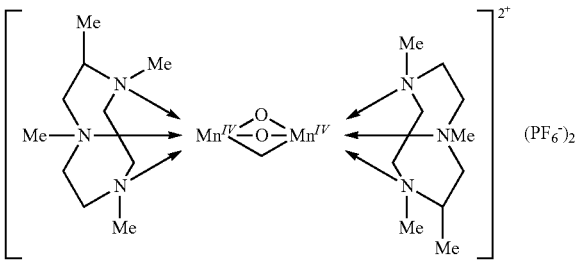

abbreviated as $[Mn^{IV}_2(\hat{A}\mu\text{–}0)_3(\text{Me-MeTACN})_2](PF_6)_2$ It is of note that the manganese complexes are also disclosed in EP-A-0458397 and EP-A-0458398 as unusually effective bleach and oxidation catalysts. In the further description of this invention they will also be simply referred to as the "catalyst".

Bleach catalyst are included in the compositions of the invention are in a preferred level of from about 0.001 to about 10%, preferably from about 0.05 to about 2% by weight of the total composition.

Automatic Dishwashing Detergent Composition

The detergent composition can comprises in addition to the alkoxylated polyalkyleneimine and the bleach system, one or more detergent active components which may be selected from surfactants, enzymes, drying aids, metal care agents, etc.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants useful herein include linear and branched compounds having the formula:

$$R3(OR4)_xN^{+}(O^{-})(R5)2$$

wherein R3 is selected from an alkyl, hydroxyalkyl, acylamidopropoyl and alkyl phenyl group, or mixtures thereof, containing from 8 to 26 carbon atoms, preferably 8 to 18 carbon atoms; R4 is an alkylene or hydroxyalkylene group containing from 2 to 3 carbon atoms, preferably 2 carbon atoms, or mixtures thereof; x is from 0 to 5, preferably from 0 to 3; and each R5 is an alkyl or hydroxyalkyl group containing from 1 to 3, preferably from 1 to 2 carbon atoms, or a polyethylene oxide group containing from 1 to 3, preferable 1, ethylene oxide groups. The R5 groups can be attached to each other, e.g., through an oxygen or nitrogen atom, to form a ring structure.

These amine oxide surfactants in particular include C10-C18 alkyl dimethyl amine oxides and C8-C18 alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are C10-C18 alkyl dimethylamine oxide, and C10-18 acylamido alkyl dimethylamine oxide.

Surfactants may be present in amounts from 0 to 15% by weight, preferably from 0.1% to 10%, and most preferably from 0.25% to 8% by weight of the total composition.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii*.

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010,925) or the subtilisin 309 wild-type (sequence as per PB92 backbone, except comprising a natural variation of N87S).

G118V+S128L+P129Q+S130A (i)

S101M+G118V+S128L+P129Q+S130A (ii)

N76D+N87R+G118R+S128L+P129Q+S130A+S188D+N248R (iii)

N76D+N87R+G118R+S128L+P129Q+S130A+S188D+V244R (iv)

N76D+N87R+G118R+S128L+P129Q+S130A (v)

V68A+N87S+S101G+V104N (vi)

Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 5 and especially from about 1 to about 4 mg of active protease per grams of product.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334).

Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Cellulases

The product of the invention preferably comprises other enzymes in addition to the protease and/or amylase. Cellulase enzymes are preferred additional enzymes, particularly microbial-derived endoglucanases exhibiting endo-beta-1,4-glucanase activity (E.C. 3.2.1.4). Preferred commercially available cellulases for use herein are Celluzyme®, Celluclean®, Whitezyme® (Novozymes A/S) and Puradax HA® and Puradax® (Genencor International).

Preferably, the product of the invention comprises at least 0.01 mg of active amylase per gram of composition, preferably from about 0.05 to about 10, more preferably from about 0.1 to about 6, especially from about 0.2 to about 4 mg of amylase per gram of composition.

Preferably, the protease and/or amylase of the product of the invention are in the form of granulates, the granulates comprise less than 29% of efflorescent material by weight of the granulate or the efflorescent material and the active enzyme (protease and/or amylase) are in a weight ratio of less than 4:1.

Builder

Builders for use herein include phosphate builders and non-phosphate builders, preferably the builder is a non-phosphate builder. If present, builders are used in a level of from 5 to 60%, preferably from 10 to 50% by weight of the composition. In some embodiments the composition comprises a mixture of phosphate and non-phosphate builders.

Phosphate Builders

Preferred phosphate builders include mono-phosphates, di-phosphates, tri-polyphosphates or oligomeric-poylphosphates. The alkali metal salts of these compounds are preferred, in particular the sodium salts. An especially preferred builder is sodium tripolyphosphate (STPP).

Non-Phosphate Builders

Preferred non-phosphate builders include aminocarboxylic builders such as MGDA (methyl-glycine-diacetic acid), GLDA (glutamic-N,N-diacetic acid), iminodisuccinic acid (IDS), carboxymethyl inulin and salts and derivatives thereof. MGDA (salts and derivatives thereof) is especially preferred herein, with the tri-sodium salt thereof being preferred and a sodium/potassium salt being specially preferred for the favourable hygroscopicity and fast dissolution properties when in particulate form.

Other suitable aminocarboxylic builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), IDS (iminodiacetic acid) and salts and derivatives thereof such as N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts and derivative thereof.

In addition to the aminocarboxylic builders the composition can comprise carbonate and/or citrate.

Preferably builders are present in an amount of up to 70%, more preferably up to 45%, even more preferably up to 40%, and especially up to 35% by weight of the composition. In preferred embodiments the composition contains 20% by weight of the composition or less of phosphate builders, more preferably 10% by weight of the composition or less, most preferably they are substantially free of phosphate builders.

Polymer

The polymer, if present, is used in any suitable amount from about 0.1% to about 30%, preferably from 0.5% to about 20%, more preferably from 1% to 10% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

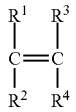

(I)

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

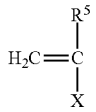

(II)

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

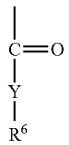

(III)

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

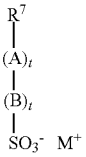

(IV)

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth)acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Other suitable polymers for use herein include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Other suitable organic polymer for use herein includes polyaspartic acid (PAS) derivatives as described in WO 2009/095645 A1.

Metal Care Agents

Metal care agents may prevent or reduce the tarnishing, corrosion or oxidation of metals, including aluminium, stainless steel and non-ferrous metals, such as silver and copper.

Preferably the composition of the invention comprises from 0.1 to 5%, more preferably from 0.2 to 4% and specially from 0.3 to 3% by weight of the composition of a metal care agent, preferably the metal care agent is a zinc salt.

Unit Dose Form

Preferably the composition of the invention is a unit-dose product. Products in unit dose form include tablets, capsules, sachets, pouches, injection moulded compartments, etc. Preferred for use herein are tablets and unit dose form wrapped with a water-soluble film (including wrapped tablets, capsules, sachets, pouches) and injection moulded containers. The unit dose form of the invention is preferably a water-soluble multi-compartment pack. Preferably, the polyalkyleneimine and the bleach are placed in different compartments, this contributes to the stability of the product.

A multi-compartments pack is formed by a plurality of water-soluble enveloping materials which form a plurality of compartments, one of the compartments would contain the composition of the invention, another compartment can contain a liquid composition, the liquid composition can be aqueous (i.e. comprises more than 10% of water by weight of the liquid composition) and the compartment can be made of warm water soluble material. In some embodiments the compartment comprising the composition of the invention is made of cold water soluble material. It allows for the separation and controlled release of different ingredients. In other embodiments all the compartments are made of warm water soluble material.

Preferred packs comprise at least two side-by-side compartments superposed (i.e., placed above) onto another compartment, especially preferred are pouches. This disposition contributes to the compactness, robustness and strength of the pack, additionally, it minimise the amount of water-soluble material required. It only requires three pieces of material to form three compartments. The robustness of the pack allows also for the use of very thin films without compromising the physical integrity of the pack. The pack is also very easy to use because the compartments do not need to be folded to be used in machine dispensers of fix geometry. At least two of the compartments of the pack contain two different compositions. By "different compositions" herein is meant compositions that differ in at least one ingredient.

Preferably, at least one of the compartments contains a solid composition, preferably in powder form and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pack.

Preferably solid:liquid weight ratio is from about 2:1 to about 18:1, more preferably from about 5:1 to about 15:1. These weight ratios are suitable in cases in which most of the ingredients of the detergent are in liquid form.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons, especially in an automatic dishwasher, the unit dose form products herein have a square or rectangular base and a height of from about 1 to about 5 cm, more preferably from about 1 to about 4 cm. Preferably the weight of the solid composition is from about 5 to about 20 grams, more preferably from about 10 to about 15 grams and the weight of the liquid compositions is from about 0.5 to about 4 grams, more preferably from about 0.8 to about 3 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916 and U.S. Pat. No. 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

Auto-Dosing Delivery Device

The compositions of the invention are extremely useful for dosing elements to be used in an auto-dosing device. The dosing elements comprising the composition of the present invention can be placed into a delivery cartridge as that described in WO 2007/052004 and WO 2007/0833141. The dosing elements can have an elongated shape and set into an array forming a delivery cartridge which is the refill for an auto-dosing dispensing device as described in case WO 2007/051989. The delivery cartridge is to be placed in an auto-dosing delivery device, such as that described in WO 2008/053191.

Abbreviations Used in the Example

In the example, the abbreviated component identifications have the following meanings:

Percarbonate: Sodium percarbonate of the nominal formula $2Na_2CO_3.3H_2O_2$

TAED: Tetraacetylethylenediamine

Cobalt catalyst: Pentaamine acetatocobalt (III) nitrate

MnTACN: 1,4,7-trimethyl 1,4,7 triazacyclononane

Sodium carbonate: Anhydrous sodium carbonate

Acusol 588: Sulfonated polymer supplied by Rohm & Haas

NI surfactant: Non-ionic surfactant

BTA: Benzotriazole

HEDP: 1-hydroxyethyidene-1,1-diphosphonic acid

MGDA: methylglycinediacetic acid

DPG: Dipropylene glycol

In the following examples the levels are quoted in grams.

EXAMPLES

The compositions tabulated below (given in grams) are introduced into a dual-compartment water-soluble pack having a first compartment comprising a solid composition (in powder form) and a liquid compartment comprising the liquid composition. The water-soluble film used is Monosol M8630 film as supplied by Monosol.

| Powder | A | B | C | D |
|---|---|---|---|---|
| Percarbonate | 1.41 | 1.41 | 1.41 | 1.41 |
| TAED | 0.32 | 0.32 | 0.32 | 0.32 |
| Cobalt catalyst | 0.0013 | 0.0013 | — | — |
| Mn TACN | — | — | 0.0013 | 0.0013 |
| Sodium carbonate | 7.17 | 7.17 | 7.17 | 7.17 |
| Sodium Sulphate | 2.5 | 2.5 | 2.5 | 2.5 |
| Amylase | 0.0013 | 0.0013 | 0.0013 | 0.0013 |
| Protease | 0.013 | 0.013 | 0.013 | 0.013 |
| Acusol 588 | 1.20 | 1.20 | 1.20 | 1.20 |
| NI surfactant | 0.10 | 0.10 | 0.10 | 0.10 |
| BTA | 0.0080 | 0.0080 | 0.0080 | 0.0080 |
| HEDP | 0.10 | 0.10 | 0.10 | 0.10 |
| MGDA | 2.20 | 2.20 | 2.20 | 2.20 |
| Liquid Top | | | | |
| NI surfactant | 1.17 | 1.17 | 1.17 | 1.17 |
| DPG | 0.44 | 0.44 | 0.44 | 0.44 |
| Amine Oxide | 0.05 | 0.05 | 0.05 | 0.05 |
| Glycerine | 0.08 | 0.08 | 0.08 | 0.08 |
| PEI600 EO7 PO1 90% Quat | — | 0.25 | — | 0.25 |

The exemplified compositions were used to wash tea stained cups in an automatic dishwasher Miele G1022SC, using the 50° C. program (Cold Fill). Hard water was used (20-21 gpg). The cups were washed in the presence of 50 g of the soil specified below. The soil is added to the dishwasher floor in the main wash. The detergent is delivered into the main wash after the dispenser drawer opens.

The cups were grading using a 1-10 grading scale where 1=highly stained cup; 10=completely clean cup. As it can be seen from the table below, the stain removal achieved by composition comprising the polyethyleneimine of the invention is far better than that achieved with compositions free of polyethylenimine.

The soil is prepared according to the following recipe:

Ingredients

| | | |
|---|---|---|
| Vegetable Oil | 1580 g +/− 1g | |
| Vegetable Oil (in separate container) | 315 g +/− 1g | |
| Margarine | 315 g +/− 1g | |
| Lard | 315 g +/− 1g | |
| Eggs | 790 g +/− 1g | |
| Cream | 470 g +/− 1g | |
| Milk | 315 g +/− 1g | |
| Potato Flakes | | 110 g +/− 1g |
| Gravy Granules | | 85 g +/− 1g |
| Corn Flour | | 30 g +/− 1g |
| Cheese Powder | | 30 g +/− 1g |
| Benzoic Acid | | 15 g +/− 1g |
| Tomato Ketchup | | 315 g +/− 1g |
| English Mustard | | 315 g +/− 1g |
| Total | | 5000 g |

Soil Preparation

1. Mix the egg and larger portion of vegetable oil together and blend with hand blender.

2. Add the mustard and ketchup stiffing them well in.

3. Melt the lard, small portion of oil and margarine together then allow to cool to approx 40° C. then add to the mixture and blend well.

4. Stir in cream and milk.

5 Crush up the smash into powder with a pestle and mortar. Add the powdered solid ingredients and mix everything to a smooth paste.

| Composition | A | B | C | D |
|---|---|---|---|---|
| Grading score | 3.8 | 7.3 | 7.3 | 10 |

Additional examples according to the present invention are provided herebelow.

| Powder | E | F | G | H |
|---|---|---|---|---|
| Percarbonate | 1.41 | 1.41 | 1.41 | 1.41 |
| TAED | 0.32 | 0.32 | 0.32 | 0.32 |
| Cobalt catalyst | 0.0013 | 0.0013 | — | — |
| Mn TACN | — | — | 0.0013 | 0.0013 |
| Sodium carbonate | 7.17 | 7.17 | 7.17 | 7.17 |
| Sodium Sulphate | 2.5 | 2.5 | 2.5 | 2.5 |
| Amylase | 0.0013 | 0.0013 | 0.0013 | 0.0013 |
| Protease | 0.013 | 0.013 | 0.013 | 0.013 |
| Acusol 588 | 1.20 | 1.20 | 1.20 | 1.20 |
| NI surfactant | 0.10 | 0.10 | 0.10 | 0.10 |
| BTA | 0.0080 | 0.0080 | 0.0080 | 0.0080 |
| HEDP | 0.10 | 0.10 | 0.10 | 0.10 |
| MGDA | 2.20 | 2.20 | 2.20 | 2.20 |
| PEI600 EO7 PO1 90% Quat | | | 0.25 | |
| PEI600 EO7 (nil PO) 75% Quat | 0.25 | | | |
| Liquid Top | | | | |
| NI surfactant | 1.17 | 1.17 | 1.17 | 1.17 |
| DPG | 0.44 | 0.44 | 0.44 | 0.44 |
| Amine Oxide | 0.05 | 0.05 | 0.05 | 0.05 |
| Glycerine | 0.08 | 0.08 | 0.08 | 0.08 |
| PEI600 EO7 PO1 90% Quat | — | — | — | |
| PEI600 EO7 (nil PO) 75% Quat | | 0.25 | | 0.25 |

Compositions E-H also provide outstanding stain removal.

Additional examples are shown herein below.

| | I | J | K | L |
|---|---|---|---|---|
| Composition | | | | |
| Grading score | 5.6 | 10 | 5.2 | 8.9 |
| Powder | | | | |
| Percarbonate | 1.625 | 1.625 | 1.625 | 1.625 |
| TAED | 1 | 1 | 0 | 1 |
| Cobalt catalyst | 0.001 | 0.001 | 0.002 | 0.002 |
| Sodium carbonate | 6.82 | 6.82 | 6.82 | 6.82 |
| Sodium Sulphate | 2.8 | 2.8 | 2.8 | 2.8 |
| Amylase | 0.0026 | 0.0026 | 0.0026 | 0.0026 |
| Protease | 0.01 | 0.01 | 0.01 | 0.01 |
| Acusol 588 | 1.20 | 1.20 | 1.20 | 1.20 |
| HEDP | 0.10 | 0.10 | 0.10 | 0.10 |
| MGDA | 2.2 | 2.2 | 2.2 | 2.2 |
| Liquid Top | | | | |
| NI surfactant | 1.17 | 1.17 | 1.17 | 1.17 |
| DPG | 0.44 | 0.44 | 0.44 | 0.44 |
| Amine Oxide | 0.05 | 0.05 | 0.05 | 0.05 |
| Glycerine | 0.08 | 0.08 | 0.08 | 0.08 |
| PEI600 EO7 75% Quat | — | 0.5 | 0.25 | 0.25 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are with The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

What is claimed is:

1. An automatic dishwashing detergent composition comprising:

a) an alkoxylated polyalkyleneimine said alkoxylated polyalkyleneimine comprising a polyalkyleneimine backbone, alkoxy chains and quaternization groups wherein the alkoxylated polyalkyleneimine has a degree of quaternization from 40% to about 98% and wherein:

i) the polyalkyleneimine backbone represents from 0.5% to 40% by weight of the alkoxylated polyalkyleneimine;

ii) the alkoxy chains represent from 60% to 99% by weight of the alkoxylated polyalkyleneimine; and b) a bleach system comprising bleach and optionally from about 1% by weight to about 20% by weight of a bleach enhancer, wherein the alkoxy chains are free of polyoxypropylene chains.

2. A composition according to claim 1 wherein the alkoxy chains comprise polyoxyethylene chains having an average of from about 1 to 50 ethoxy units.

3. A composition according to claim 1 wherein the alkoxy chains comprise polyoxyethylene chains having an average of from about 1 to about 10 ethoxy units.

4. A composition according to claim 1 wherein the alkoxylated polyalkyleneimine is obtained from alkoxylation followed by quaternization of a polyalkyleneimine having a weight-average molecular weight of from about 100 to about 60,000 g/mol.

5. A composition according to claim 1 wherein the bleach is selected from the group consisting of inorganic bleach, organic bleach and mixtures thereof.

6. A composition according to claim 1 comprising a bleach enhancer wherein the bleach enhancer is selected from the group consisting of a bleach catalyst, a bleach activator and mixtures thereof.

7. A composition according to claim 1 wherein the bleach enhancer is a metal bleach catalyst, and wherein the metal is selected from the group consisting of cobalt, manganese, iron, copper and mixtures thereof.

8. A composition according to claim 1 wherein the bleach enhancer is a bleach activator, and wherein the bleach activator is selected from the group consisting of TAED, NOBS, DOBA and mixtures thereof.

9. A composition according to claim 1 wherein the composition further comprises a non-ionic surfactant and wherein the composition is free of anionic and cationic surfactants.

10. A composition according to claim 1 wherein the composition is free of phosphate builder.

11. A composition according to claim 1 wherein the composition further comprises a sulfonated polymer.

12. A composition according to claim 1 wherein the composition is in unit dose form.

13. A method of cleaning cookware/tableware in an automatic dishwashing machine comprising the step of subjecting the cookware/tableware to a washing liquor comprising a composition according to claim 1.

* * * * *